United States Patent [19]

Feuchter et al.

[11] Patent Number: 4,706,450

[45] Date of Patent: Nov. 17, 1987

[54] BRAKE FOR AN OPEN-END SPINNING ROTOR

[75] Inventors: Wolfgang Feuchter, Deggingen-Reichenbach; Dieter Goetz, Geislingen-Steige, both of Fed. Rep. of Germany

[73] Assignees: Fritz Stahlecker; Hans Stahlecker, both of Fed. Rep. of Germany

[21] Appl. No.: 29,672

[22] Filed: Mar. 24, 1987

[30] Foreign Application Priority Data

Apr. 24, 1986 [DE] Fed. Rep. of Germany ..... 3613843

[51] Int. Cl.[4] ..... D01H 7/22; D01H 7/885; D01H 1/241

[52] U.S. Cl. ..... 57/88; 57/405

[58] Field of Search ..... 57/78, 88, 261, 263, 57/405

[56] References Cited

U.S. PATENT DOCUMENTS 3,116,591 1/1964 Muller ..... 57/88
3,122,875 3/1964 Swift et al. ..... 57/88
3,406,512 10/1968 Stahlecker ..... 57/88
4,265,083 5/1981 Braun et al. ..... 57/263
4,326,372 4/1982 Inger ..... 57/88
4,402,177 9/1983 Grimm et al. ..... 57/88

*Primary Examiner*—Donald Watkins

[57] ABSTRACT

In the case of a supporting roller bearing for a horizontally arranged spinning rotor, it is provided that braking means are arranged below a tangential belt moving between two pairs of supporting roller. The braking means contain two brake shoes that can be applied essentially horizontally to the shaft from the direction of two sides, said brake shoes being arranged on tong arms. The applying of the brake shoes takes place in such a way that the brake shoe that during the application moves in moving direction of the tangential belt comes to rest against the shaft before the other brake shoe. In addition, it is provided that a tension roller loading the tangential belt in normal operation, during the braking, will not be moved off the tangential belt before both brake shoes are applied to the shaft.

13 Claims, 2 Drawing Figures

BRAKE FOR AN OPEN-END SPINNING ROTOR

BACKGROUND AND SUMMARY OF THE INVENTION

The invention relates to a brake for an open-end spinning rotor having a horizontally located shaft that is disposed in the wedge-shaped gap of at least one pair of supporting rollers, said shaft being driven by means of a tangential belt that is loaded by means of a tension roller in the direction of the wedge-shaped gap, said tension roller, for the interruption of the drive, being removable from the wedge-shaped gap, and having braking means that can be applied to the shaft located in the wedge-shaped gap and that contain two brake shoes that can be applied to the shaft from opposite sides.

A brake of this type, is described in the unpublished German Pat. Application No. P 35 33 717.6. In the case of this brake, the two brake shoes are applied to the shaft of the spinning rotor simultaneously. Practical tests have shown that it is important for a brake of this type that the simultaneousness of the application of the brake shoes is ensured. When this simultaneousness is no longer ensured and is reduced, for example, by play that may occur over a period of time or by deviations caused by wear, there is the danger that the shaft, during the braking, can no longer be held steadily in the wedge-shaped gap. This may result in damage to the fittings of the supporting rollers and/or the shaft and/or the brake shoes. It should therefore be ensured, at relatively high expenditures, that this simultaneousness of the application movement is maintained also during an extended operating time.

An objective of the invention is to develop a brake of the initially mentioned type in such a way that during the braking, the shaft of the spinning rotor is held securely in the wedge-shaped gap without the disturbing effect of wear phenomena and/or of tolerances.

This objective is achieved according to preferred embodiments of the invention by providing that the brake shoes are developed and/or arranged with respect to one another and/or operable in such a way that the brake shoe that carries out a braking application movement toward the shaft of the spinning rotor in the moving direction of the tangential belt will rest against the shaft before the other brake shoe.

By means of this development, an intentional deviation from the simultaneousness of brake shoe application takes place that has a dimension that is so large that also in the case of tolerances and wear after an extended operating time, a deviation into another direction does not have to be feared. By means of the brake shoe that is to be applied in the moving direction of the tangential belt, the shaft, during the application, is first pressed against the supporting roller rotating into the wedge-shaped gap so that a rolling of the shaft out of the wedge-shaped gap is securely prevented.

In a further development of certain preferred embodiments of the invention, it is provided that the two brake shoes are arranged in an area below the tangential belt and can be applied essentially horizontally to the shaft, with each brake shoe being arranged on a tong arm. By means of this development, it is possible to move the pairs of supporting rollers close to one another so that a high critical rotational speed is obtained for the system comprising the spinning rotor and the shaft so that the spinning rotor can run at very high rotating speeds.

In a further development of preferred embodiments of the invention, it is provided that each tong arm is pivotable around its own axis extending essentially in parallel to the rotor shaft. Advantageously, it is also provided in this case that the axes of the tong arms are arranged at a horizontal distance that corresponds to at least twice the diameter of the rotor shaft. With this arrangement of the pivot axes of the tong arms, there will be a low component of force in the direction into the wedge-shaped gap so that the reliability with respect to the securing of the position of the shaft is increased, even when the brake shoes are applied essentially horizontally and radially against the rotor shaft.

In a further development of preferred embodiments of the invention, it is provided that the tong arms are developed as constructionally identical and mirror-symmetrically arranged double levers. With respect to the lever arm ends facing away from the brake shoes, a joint actuating means is assigned that, for the application of the brake shoes to the shaft, moves these arm ends apart. In order to permit a controlled, time-offset application of the brake shoes, it is provided, in the case of a first embodiment, that the actuating means is designed and/or arranged in such a way that the tong arms can be actuated at a time interval after one another. In the case of another embodiment, it is provided that the joint actuating means that is used for the simultaneous operation of the tong arms is arranged outside a plane that extends through the rotor shaft and vertically to the plane containing the axes of the tong arms. As a result, the tong arms that are to be actuated jointly are set in such a way that the brake shoe that is to run first against the rotor shaft, is located closer to the rotor shaft. In order provide the possibility to be able to, after a certain operating time, despite wear, again adjust the desired time functions, it is advantageously provided that the actuating means is adjustable.

In a further development of preferred embodiments of the invention, it is provided that the distance of the brake shoes from the rotor shaft that exists in the operating condition can be adjusted by means of an adjustable stop means. This distance is selected to be just large enough so that the rotor shaft in the operating condition is free of the brake shoes.

In a further development of preferred embodiments of the invention, it is provided that an actuating device for the moving-away of the tension roller is designed in such a way that the moving-away of the tension roller, with respect to time, takes place after the application of the brake shoes. Thus, it is ensured that the shaft of the spinning rotor at no time is uncontrolled and unloaded during the braking.

Further objects, features and advantages of the present invention will become more apparent from the following description when taken with the accompanying drawings, which show for purposes of illustration only, embodiments constructed in accordance with the present invention.

Figure 1:
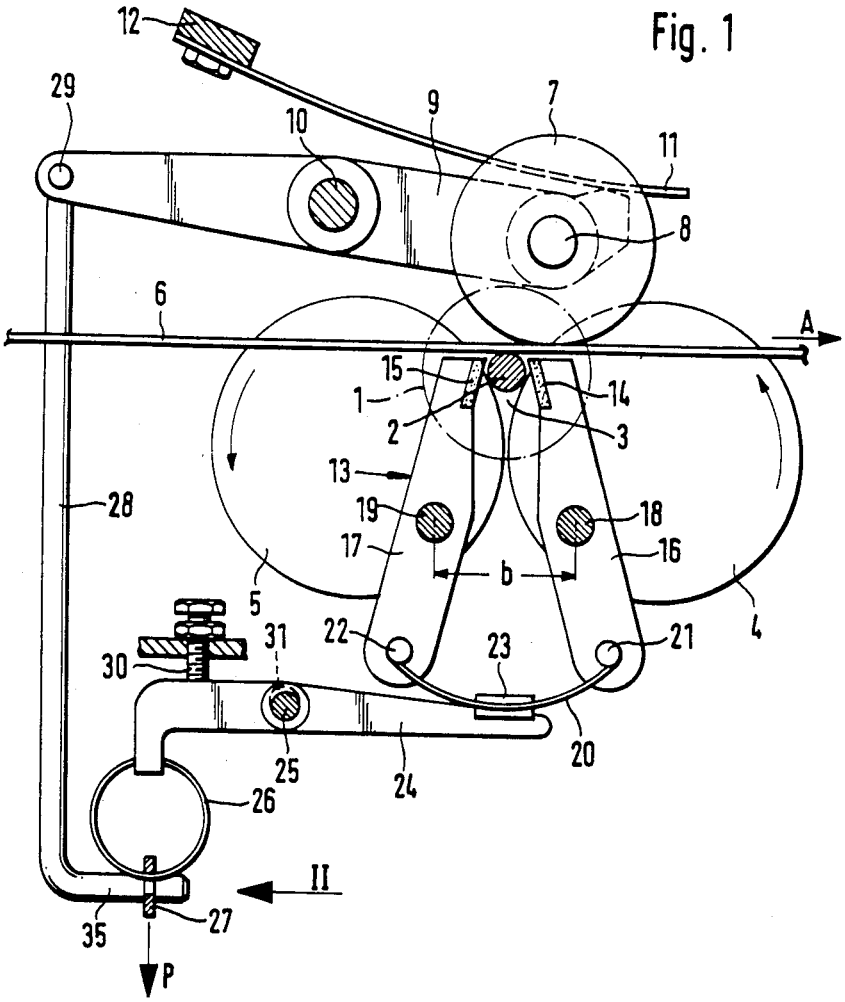
FIG. 1 is a diagrammatic, partially sectional schematic view of a brake system constructed according to a preferred embodiment of the invention and having a bearing for an open-end spinning rotor, as viewed in the longitudinal direction of the shaft of the spinning rotor.

In the drawings only those portions of an open-end rotor spinning machine are illustrated that are needed for one skilled in the art to understand, make and use the invention. It will be understood by those skilled in the art that the invention can be utilized in open-end rotor spinning machines of the type commercially available through the company W. Schlafhorst & Co. of Manchengladbach, West Germany as such commercial machines have a plurality of adjacent commonly driven spinning stations as the type depicted in FIGS. 1 and 2. The bearing supporting the spinning rotor shaft in this Schlafhorst machine uses a so-called Suessen Twin Disk Bearing.

DETAILED DESCRIPTION OF THE DRAWINGS

Figure 2:
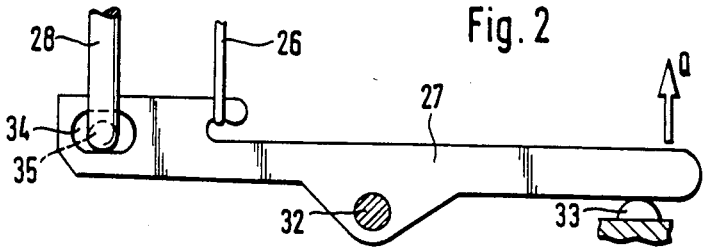
FIG. 2 is an enlarged schematic view of a detail taken in the direction of the Arrow II of FIG. 1.

In FIG. 1 the outer circumference of a rotor disk 1 of a spinning rotor is indicated only by a dash-dotted line. The rotor disk 1 of the spinning rotor is equipped in a known way with a rotor shaft 2 that is disposed in a wedge-shaped gap 3 that is formed by two pairs of supporting rollers arranged at an axial distance, of which supporting rollers 4 and 5 are indicated in FIG. 1. Twin disk bearing arrangements of this type are described in U. S. Pat. No. 3,779,620. The horizontally disposal rotor shaft 2 is driven by means of a tangential belt 6 moving through in the longitudinal direction of the machine and moving in the direction of the Arrow A. Belt 6 drives the rotor shafts 2 of all spinning rotors of the spinning units of one side of the machine. The tangential belt 6 is applied to the rotor shaft 2 from above and thus during the operation secures rotor shaft 2 in the wedge-shaped gap 3 of the pairs of supporting rollers.

In the operating condition, the tangential belt 6 is loaded by a tension roller 7 which rotates freely about shaft 8 carried on a lever 9 that can be swivelled around a stationary axis 10. The lever 9 is loaded by means of a load spring 11 that loads the tension roller 7 in the direction of the wedge-shaped gap 3. A leaf spring 11 that is fastened at a stationary clamping point 12 is used as the load spring.

In order to stop the spinning rotor, a brake 13 is provided that is assigned to the rotor shaft 2. This brake 13 contains two brake shoes 14, 15 that can be applied to the shaft essentially radially and horizontally. The brake shoes 14 and 15 are arranged below the tangential belt 6 in the area between the pairs of supporting rollers and arranged at an axial distance from them. The two brake shoes 14 and 15 in each case are arranged on tong arms 16 and 17 that can be swivelled around stationary axes 18 and 19. The two axes 18 and 19 are arranged at a horizontal distance b from one another that corresponds to at least twice the diameter of the rotor shaft 2 and preferably more than 2.5 times the diameter of the rotor shaft 2. The distance of the axes 18 and 19 in the vertical direction from the rotor shaft 2 corresponds to approximately four times the diameter of the rotor shaft 2 so that the brake shoes 14 and 15, when applied to the rotor shaft 2, move in the direction into the wedge-shaped gap 3 with a downward moving component.

The tong arms 16, 17 carrying the brake shoes 14, 15 are developed as double-armed levers or double levers, the arm ends of which that face away from the brake shoes 14, 15 are in each case connected with a joint actuating element at coupling points 21 and 22. A leaf spring 20 that is curved through in downward direction is used as the joint actuating element.

The leaf spring 20 that is used as the actuating element, is fastened in its center by means of a tension element 23 at a double-armed actuating lever 24 that is pivotable around a shaft 25 extending essentially in parallel to the axes 18 and 19. At the free end of the double-arm lever 24, an annular spring 26 is hinged that is wound around a nose of a braking lever 27 that can be swivelled around a shaft 32 extending transversely to the shaft 25.

The braking lever 27 is provided in the area of the nose having the annular spring 26 with a recess 34 into which the bent-away end 35 of a lever 28 is hooked that, via a joint 29, is connected with the free arm of the lever 9 that is developed as the double-armed lever and receives the tension roller 7.

The braking lever 27 which in the normal operating condition rests against a stop means 33 is moved in the direction of the Arrow Q with a force required for the braking for the actuating of the brake 13. As a result, the other arm of the braking lever 27 carries out a motion in the direction of the Arrow P (FIG. 1), whereby, on the one hand, the brake 13 is actuated, while, on the other hand, the tension roller 7 is moved in the direction away from the wedge-shaped gap 3 and is lifted off the tangential belt 6.

In order to ensure controlled conditions during the braking and also during the restarting, in which the shaft 2 is held continuously in the wedge-shaped gap 3, the brake 13 is designed in such a way that the brake shoe 15 that for the braking carries out an application movement in moving direction A of the tangential belt 6 comes to rest against the rotor shaft 2 before the brake shoe 14. As a result, the rotor shaft 2 is pressed first against that supporting roller 4 of the pairs of supporting rollers that, because of the moving direction A of the tangential belt 6 rotates into the wedge-shaped gap 3. The rotor shaft 2 is therefore held securely in the wedge-shaped gap 3. The second brake shoe 14 that moves opposite the moving direction A of the tangential belt 6 when it is applied to the rotor shaft 2, is applied with a slight time delay.

This time delay of the application of the brake shoes 15 and 14 can be caused in different ways according to various preferred embodiments of the invention. In the case of the illustrated embodiment, it is provided that the brake shoe 15, in the shown operating position, has a shorter travel distance to the shaft 2 than the brake shoe 14, so that, despite the simultaneous actuating of the two tong levers 16, 17 carrying the brake shoes 14 and 15, brake shoe 15 comes to rest earlier against the rotor shaft 2 than the brake shoe 14. This smaller distance of the brake shoe 15 from the shaft 2, in the case of the shown embodiment, is achieved in such a way that the tension element 23 that holds the joint actuating element 20 which is the leaf spring, is offset in the direction of the tong arm 17 with respect to a vertical plane that extends through the rotor shaft 2 and perpendicularly with respect to the connecting plane of the axes 18 and 19. The position of the actuating element 20 that is offset with respect to this vertical plane can be adjusted. For this purpose, it is provided in a first embodiment, that the tension element 23 holding the actuating element 20 is mounted at the lever 24 so that it can be adjusted correspondingly. In the case of the shown embodiment, it is provided that the whole lever 24 with the tension element 23 and the actuating element 20 can be adjusted correspondingly. For this purpose, the axis 25 around which the lever 24 can pivoted is developed as an eccentric axis as shown by the contour 31 shown by an interrupted line. By the turning of the axis 25, 31, the position of the actuating element 20 can therefore be adjusted. The operating position of the brake 13 shown in FIG. 1 is secured by a stop means 30 assigned to the lever 24 that is developed as an adjusting screw equipped with a check nut.

In order to ensure that during the whole braking process no undefined condition occurs for the rotor shaft 2, it is also provided that the tension roller 7 will not be moved away from the wedge-shaped gap 3 and the tangenial belt 6 before the brake shoes 14 and 15 have come to rest against the rotor shaft 2. In the case of the shown embodiment, this is caused in a simple way by the fact that a corresponding play is provided in the area of the recess 34, by means of which the lever 28, via its bent-away end 35 is connected with the braking lever 27.

During the transition from the braked condition to the normal operating position, the reverse sequence of movements takes place; i.e., first the tension roller 7 is applied to the tangential belt 6 and the wedge-shaped gap 3, after which the brake shoes 14, 15 release the rotor shaft 2. In this case, the brake shoe 14 detaches itself from the rotor shaft 2 before the brake shoe 15.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A brake for an open-end spinning rotor of the type having a horizontally disposed rotor shaft disposed in a wedge-shaped gap of at least one pair of supporting rollers with said rotor shaft being driven by a tangential belt, said brake comprising:

first and second brake shoes engagable with respective opposite sides of the rotor shaft for applying braking forces, said first brake shoe being movable in substantially the same direction as the tangential belt during braking operation, and brake shoe actuation means for actuating the brake shoes so that the first brake shoe engages the rotor shaft before the second brake shoe.

2. A brake according to claim 1, wherein the first and second brake shoes are arranged in an area below the tangential belt and are movably applied to the rotor shaft essentially in horizontal direction by the brake shoe actuating means, and wherein each brake shoe is arranged on a tong arm.

3. A brake according to claim 2, wherein each tong arm can be pivoted around its own axis that extends essentially in parallel to the rotor shaft.

4. A brake according to claim 3, wherein the axes of the tong arms are arranged at a horizontal distance from one another that corresponds to at least twice the diameter of the rotor shaft.

5. A brake according to of claim 4, wherein the tong arms are developed as constructionally identical and mirror-symmetrically arranged double levers, said brake shoe actuation means including a joint actuating means assigned to the tong arm ends facing away from the brake shoes for moving these tong arm ends apart for the application of the brake shoes to the rotor shaft.

6. A brake according to claim 5, wherein the joint actuating means are configured in such a way that the tong arms can be actuated at a time interval after one another.

7. A brake according to claim 5, wherein the joint actuating means includes an element that is used for the simultaneous actuating of the tong arms, said element being located with its center offset from a plane that extends through the rotor shaft and perpendicularly with respect to the plane containing the axes of the tong arms.

8. A brake according to claim 7, wherein the actuating means is adjustable.

9. A brake according to claim 8, wherein the distance of the brake shoes to the rotor shaft that exists during the operating condition can be adjusted by means of an adjustable stop means.

10. A brake according to claim 9, wherein said brake shoe actuation means includes an actuating device provided for the actuating means of the brake shoes, said actuating device containing at least one spring element acting in actuating direction.

11. A brake according to claim 10, wherein a tension roller is provided for tensioning the tangential belt toward the rotor shaft, and wherein an actuating device for moving away the tension roller is designed in such a way that the moving-away of the tension roller, with respect to time, takes place after the application of the brake shoes to the rotor shaft.

12. A brake according to claim 11, wherein the actuating device contains a double-armed lever that is disposed on an eccentric shaft.

13. A brake according to claim 1, wherein a movable tension roller is provided for tensioning the tangential belt against the rotor shaft, and wherein means are provided for controlling the brake shoe actuation means in such a manner that, during application of the brake shoes, the tension roller is released from its position with the belt driving the rotor shaft only after the engagement of the brake shoes to the rotor shaft.

* * * * *